US009637366B2

(12) United States Patent
Kennedy et al.

(10) Patent No.: US 9,637,366 B2
(45) Date of Patent: May 2, 2017

(54) REEL HANDLING DEVICE AND METHOD

(71) Applicant: Cerro Wire LLC, Hartselle, AL (US)

(72) Inventors: William Kennedy, Falkville, AL (US); John Hardiman, Madison, AL (US)

(73) Assignee: CERRO WIRE LLC, Hartselle, AL (US)

( * ) Notice: Subject to any disclaimer, the term of this patent is extended or adjusted under 35 U.S.C. 154(b) by 326 days.

(21) Appl. No.: 14/149,996

(22) Filed: Jan. 8, 2014

(65) Prior Publication Data

US 2014/0193235 A1 Jul. 10, 2014

Related U.S. Application Data

(60) Provisional application No. 61/750,134, filed on Jan. 8, 2013.

(51) Int. Cl.
*B66F 9/18* (2006.01)
*B65H 49/38* (2006.01)

(52) U.S. Cl.
CPC ..... *B66F 9/187* (2013.01); *B65H 49/38* (2013.01)

(58) Field of Classification Search
CPC .... B66F 9/18; B66F 9/187; B66F 9/14; B66F 9/142; B65H 49/38
USPC ..... 414/607
See application file for complete search history.

(56) References Cited

U.S. PATENT DOCUMENTS 3,157,370 A * 11/1964 Govatsos ..... A47K 10/40 242/560.2
4,467,893 A * 8/1984 Hobson ..... B66F 9/08 182/69.1
5,366,339 A * 11/1994 Gould ..... B66F 9/187 294/90
9,120,636 B2 * 9/2015 Cavirani ..... B65H 19/12
2011/0280701 A1 * 11/2011 Brighenti ..... B65H 19/102 414/621
2012/0153654 A1 * 6/2012 Cole ..... B66C 9/18 294/119.1

* cited by examiner

*Primary Examiner* — Michael McCullough
*Assistant Examiner* — Ashley Romano
(74) *Attorney, Agent, or Firm* — Levenfeld Pearlstein, LLC

(57) ABSTRACT

A device for handling reels includes a telescoping assembly with a first fork sleeve and a second fork sleeve attached to the telescoping assembly so that a position of the first fork sleeve may be adjusted with respect to a position of the second fork sleeve. A first reel lifter fitting and a second reel lifter fitting are attached to the telescoping assembly so that a position of the first reel lifter fitting may be adjusted with respect to a position of the second reel lifter fitting. A first reel lifter arm having a first hook portion and a second reel lifter arm having a second hook portion are slidingly received within the first and second reel lifter fittings.

16 Claims, 7 Drawing Sheets

REEL HANDLING DEVICE AND METHOD

CROSS REFERENCE TO RELATED APPLICATIONS

This application is a U.S. Non-provisional Application, which claims priority from Patent Application No. 61/750,134 filed Jan. 8, 2013. The entirety of the above-listed application is incorporated herein by reference.

FIELD OF THE INVENTION

The present invention relates generally to reel or spool handling equipment and, in particular, to a reel handling device and method.

BACKGROUND

Many industries require use of large spools or reels for storing elongated products such as cables, wire, tubing, rope and the like. More specifically, cable (for example) is wound about the reel several times for space efficient storage and ease of use. The reels are quite heavy, especially when loaded with cable, and thus require equipment, such as a forklift truck, for handling. As a result, equipment has been developed to facilitate the carrying of reels by forklift trucks and the like.

Prior art devices used for carrying reels on forklift trucks typically feature two components that must be attached one each to the forks of a forklift truck. As a result, they suffer from a number of drawbacks. More specifically, (1) it is time consuming and cumbersome to attach the two pieces of the device to the forks of a forklift. Furthermore, (2) the two pieces must be picked up and fitted onto the forks by hand. Since the two pieces are handled manually, they are subject to abuse and damage. In addition, (3) the two pieces of the device must be manually positioned on the forks so that they are aligned with each other. Also, tools must be used to adjust the prior art devices. More specifically, (4) an allen wrench is typically needed to fix the devices onto each fork of a forklift and (5) in order to change the length of the lifting hooks, a pair of pliers is typically required to remove cotter pins on each lifting hook in order to reposition them for a different size reel. Finally, (6) the prior art devices require more than one different model to pick up the full range of reel sizes.

A need therefore exists for a reel handling device and method that addresses at least some of the above issues.

DETAILED DESCRIPTION OF EMBODIMENTS

Figure 1:
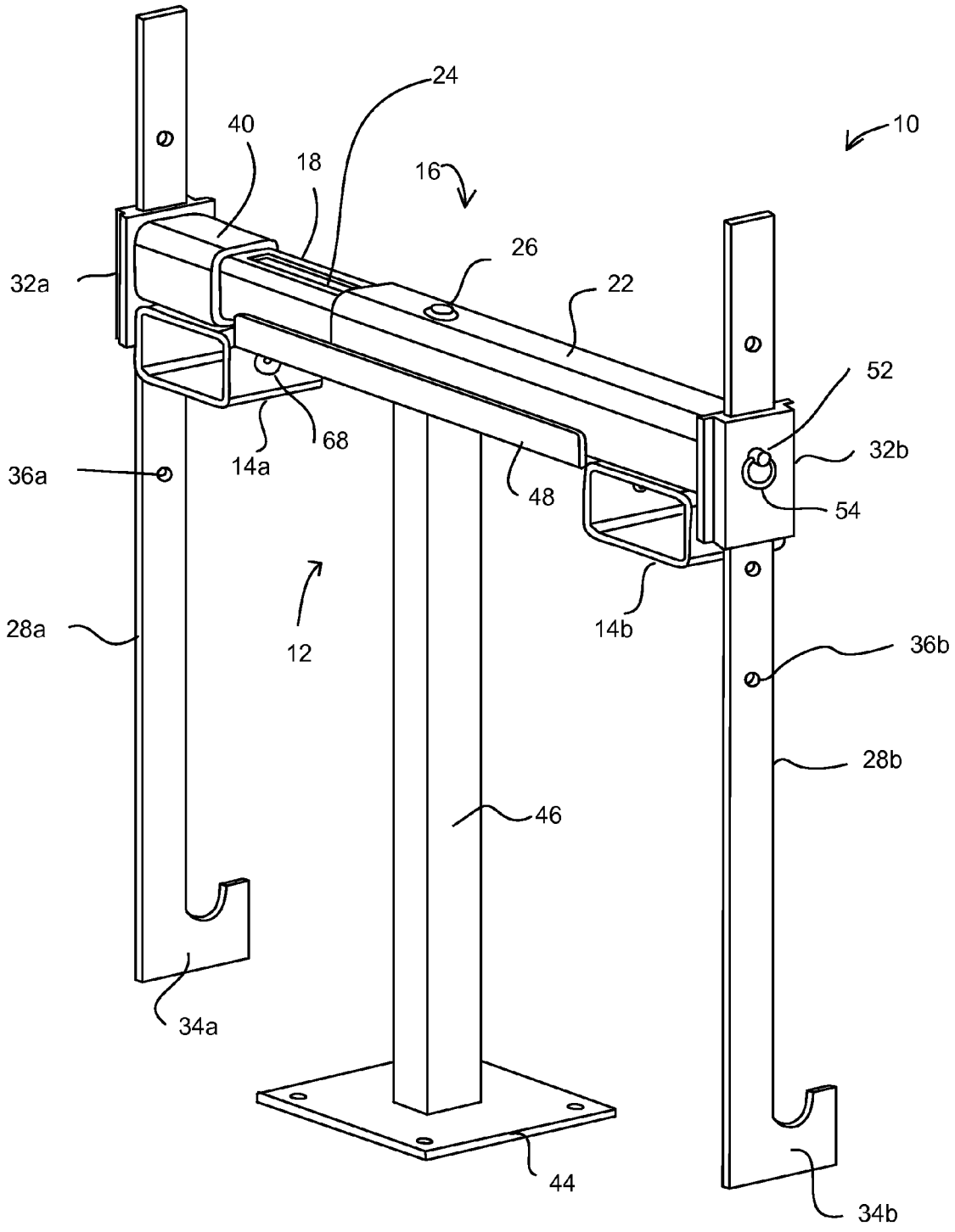
FIG. 1 is a perspective view of an embodiment of the reel handing device of the present invention supported on a stand.

An embodiment of the reel handling device of the present invention is indicated in general at 10 in FIG. 1. The device is shown resting on a stand, indicated in general at 12.

As indicated in FIG. 1, the reel handing device includes a pair of fork sleeves 14*a* and 14*b* that are each tubular with a generally rectangular cross-section. Of course the fork sleeves, which are preferably constructed from steel, may have a shape other than rectangular.

The fork sleeves are secured to the underside and near the opposite ends of a telescoping assembly, indicated in general at 16. The telescoping assembly includes an inner slider bar 18 that is received within a hollow outer slider bar 22 in a telescoping fashion. The top of the inner slider bar is provided with an elongated slot 24. The outer slider bar is provided with a sliding pin 26 that protrudes inward so as to be received within the elongated slot 24 of the inner slider bar. The sliding pin 26 traverses the elongated slot as the inner slider bar 18 is moved into and out of the outer slider bar as the telescoping assembly is adjusted as described below. The pin 26 engages the ends of the elongated slot 24 to limit the travel of the inner slider bar within the outer slider bar.

A pair of reel lifter arms 28*a* and 28*b* are received within corresponding slotted reel lifter fittings 32*a* and 32*b* in a sliding fashion. Reel lifter arms 28*a* and 28*b* are each provided with bottom hook portions 34*a* and 34*b* and a number of locator holes 36*a* and 36*b*. Reel lifter fitting 32*a* is rigidly secured to the distal end of inner slider bar 18 via collar 40, while reel lifter fitting 32*b* is rigidly secured to the distal end of outer slider bar 22.

Figure 2:
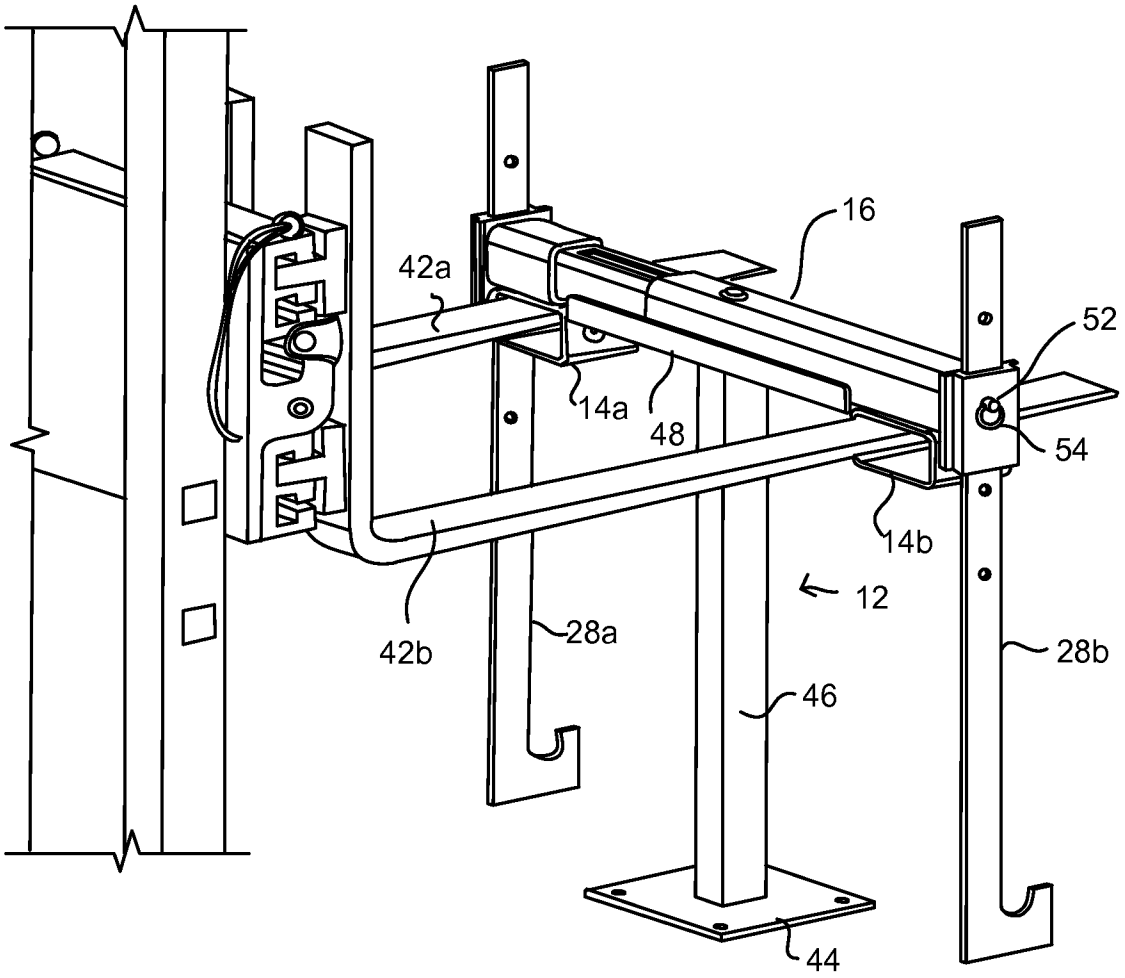
FIG. 2 is a perspective view of the reel handling device of FIG. 1 being lifted by a forklift.

As illustrated in FIG. 2, the sturdy telescoping assembly 16 of the reel handling device keeps the reel lifter arms 28*a* and 28*b* properly aligned while being attached to the forks 42*a* and 42*b* of a forklift truck.

The telescoping assembly also allows the device to be stored on the fixed stand 12 which holds the device in a position to be easily mounted on the forklift forks without the driver having to get off the forklift, except to tighten locking hand screws without a tool (as explained below). The stand 12 includes a base 44, a main vertical support 46 and a cradle 48 positioned at the top of the support. The cradle preferably is U-shaped so as to support the device via the inner and outer slider bars of the telescoping assembly with the hook portions of the reel lifters elevated above the floor or other surface supporting the base 44 of the stand.

All of the components of the stand, the telescoping assembly, the reel lifters and the reel lifter fittings are preferably constructed of steel.

Figure 6:
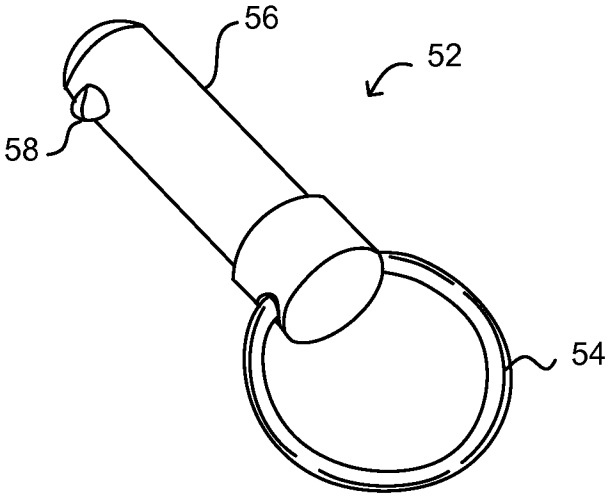
FIG. 6 is an enlarged perspective view of a ball-lock pin of the type used on the embodiment of the reel handling device of FIGS. 1-5.

The heavy duty hook portions 34*a* and 34*b* and locator holes 36*a* and 36*b* of the reel lifter arms 28*a* and 28*b* can be positioned to accommodate various sizes of reels. The reel lifter arms are each locked into the proper position using a ball-lock pin, indicated at 52 in FIGS. 1, 2 and 6. Such ball-lock pins are well known in the art. Each ball-lock pin requires no tools to remove or reposition as it may simply be pulled out of the corresponding opening in the side of the reel lifter fitting via pull ring 54 and pushed back into position where the stem 56 (FIG. 6) passes through reel lifter fitting opening and the selected locator hole (36*a*, 36*b* of FIG. 1). Spring-loaded retractable locking balls, 58 of FIG. 6, secure the ball-lock pin 52 in place.

Figure 7:
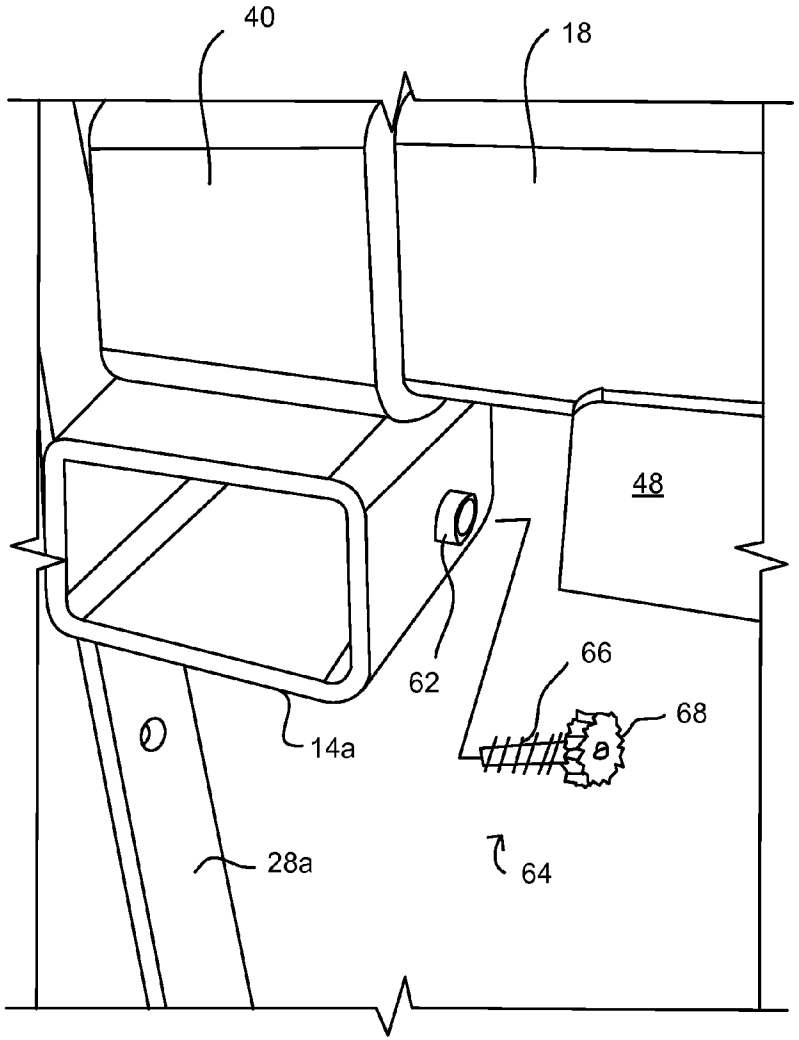
FIG. 7 is an enlarged perspective view illustrating one of the forklift fittings and corresponding locking hand screw.

With reference to FIGS. 1 and 7, the inward-facing wall of fork sleeve 14*a* is provided with a boss 62 that includes a threaded bore that extends into the interior of the fork sleeve. A locking hand screw, indicated in general at 64 in FIG. 7, features a threaded shaft 66 that engages the threaded bore of the boss 62. The locking hand screw also features a knob 68 attached to the distal end of the threaded shaft 66. Fork sleeve 14*b* is provided with a similar boss and locking hand screw arrangement. With reference to FIG. 2, after the forks 42*a* and 42*b* of the forklift are inserted into the corresponding fork sleeves 14*a* and 14*b*, the locking hand screws are turned so that the proximal ends of the threaded shafts (66 of FIG. 7) engage the forks to secure the device to the forklift.

Figure 3:
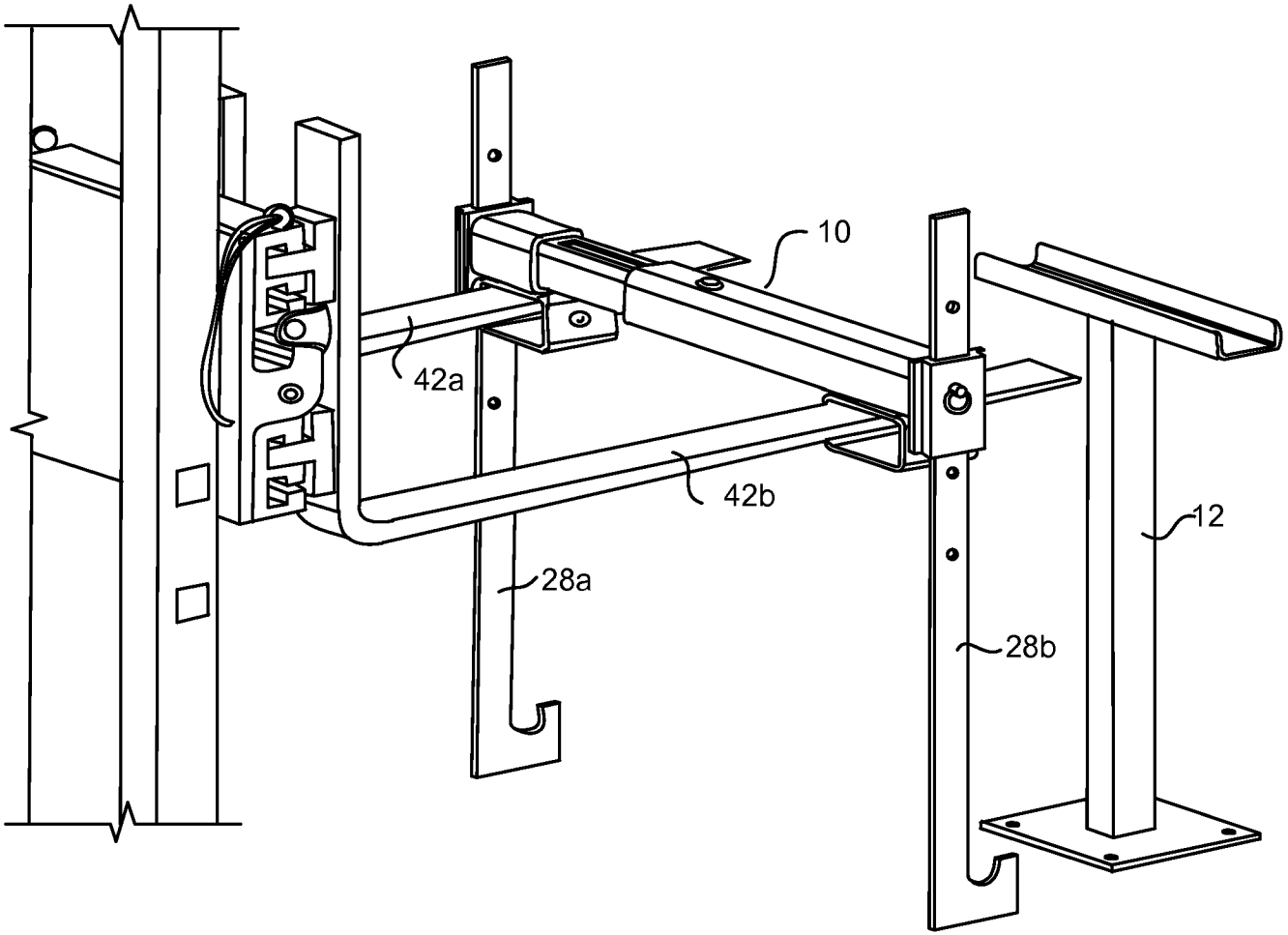
FIG. 3 is a perspective view of the reel handling device of FIGS. 1 and 2 being carried by a forklift.

With the reel handing device 10 attached to the forks 42*a* and 42*b* of the forklift and the reel lifter arms 28*a* and 28*b* adjusted to the right length, the forklift operator lifts the device off of the stand 12, as illustrated in FIG. 3.

Figure 4:
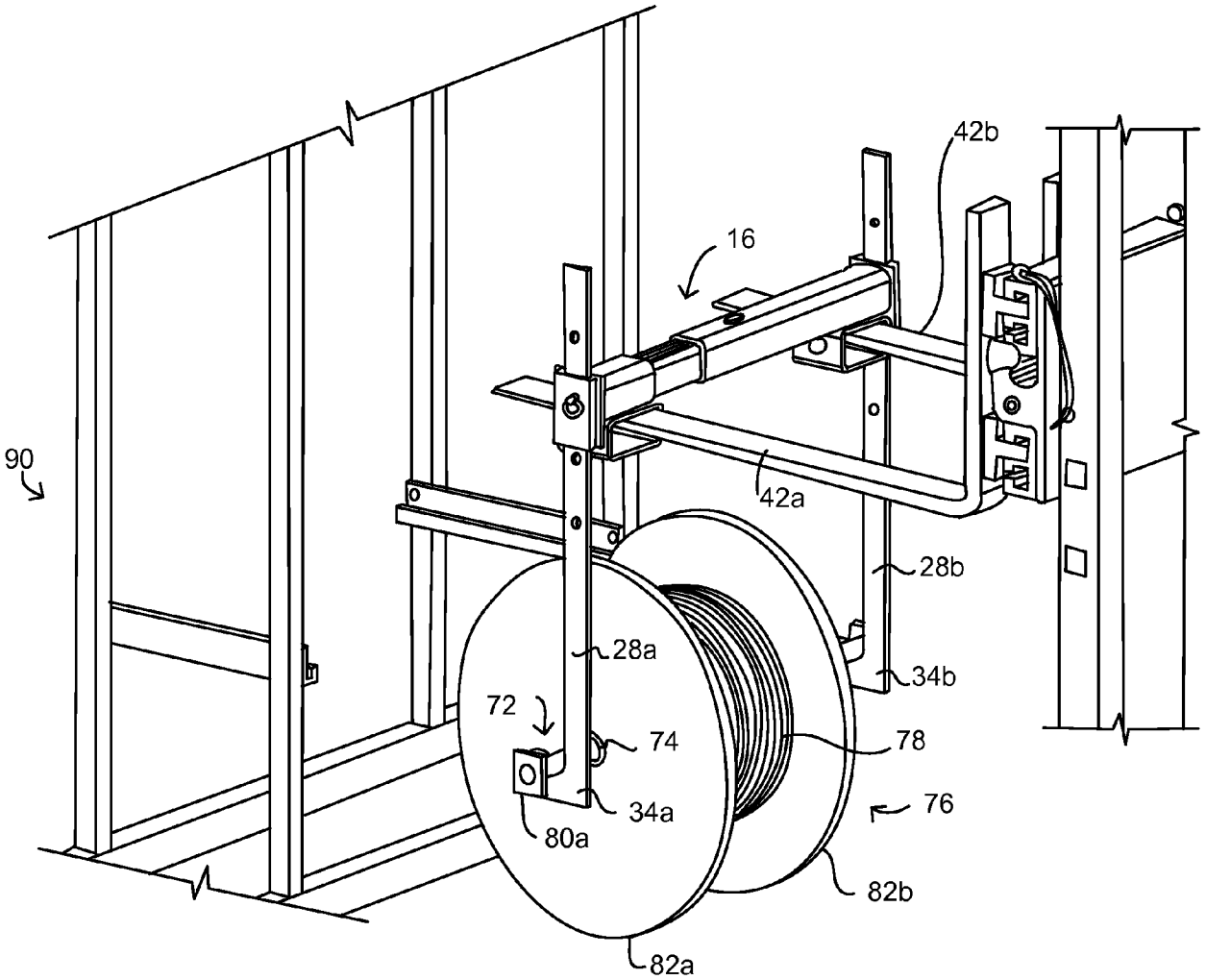
FIG. 4 is a perspective view of the reel handling device of FIGS. 1-3 carrying a reel towards a reel storage rack.
Figure 5:
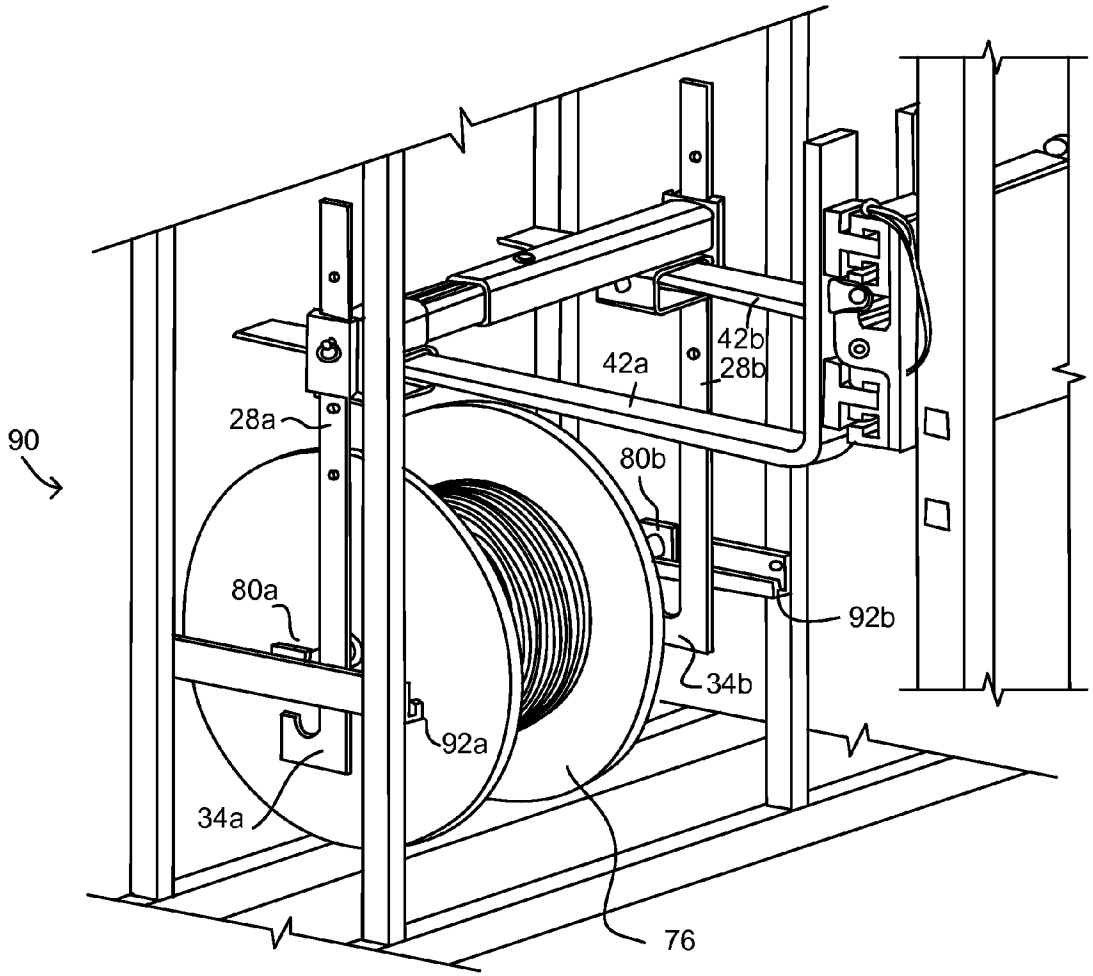
FIG. 5 is a perspective view of the reel handling device of FIGS. 1-4 placing the reel on the reel storage rack.

The driver next drives the forklift up to a reel to be lifted. As illustrated in FIG. 4, a special arbor or shaft, indicated in general at 72, is already positioned in the reel arbor hole 74 and protrudes from both sides of the reel, indicated in general at 76. This may be achieved, for example, by providing the special shaft 72 with a two-piece construction where the inner ends of each piece of the special shaft are joined after passing one each through the arbor hole openings of the reel with a fastening arrangement such as a threaded bore on one inner end and a corresponding threaded end on the other inner end. Of course alternative fastening arrangements may be used, or the special shaft may be constructed as a single piece that is slid through both arbor hole openings and through the entire width of the reel. In the example illustrated, the reel is loaded or wound with cable 78. The ends of the special shaft are provided with square end plates 80*a* and 80*b* (FIG. 5). Alternative shapes and sizes may be used for the end plates.

The distance between the reel lifter arms 28*a* and 28*b* are adjusted in close to the flanges 82*a* and 82*b* of the reel using the fork adjustment feature of the forklift and the telescoping assembly 16 of the reel handing device. The forklift advances toward the reel so that the hook portions 34*a* and 34*b* of the reel lifter arms hook under the shaft, as illustrated in FIG. 4. The reel can now be lifted safely and transported to a reel rack, indicated in general at 90 in FIGS. 4 and 5, designed to receive the special shafts. More specifically, with reference to FIG. 5, the reel rack includes a pair of reel supports 92*a* and 92*b* that feature a J-shaped cross section so that each includes a channel adapted to receive the square end plates 80*a* and 80*b* of the special shaft supporting the reel 76.

As illustrated in FIG. 5, the special shaft, and thus the reel, is placed into position in the rack 90. With the special shaft securely in place in the rack, the forks 42*a* and 42*b* and reel lifter arms 28*a* and 28*b* can be lowered and disengaged from the special shaft and the forklift backed away from the rack. The process is reversed to remove an empty reel from the rack or to move a partially full reel.

The embodiment of the reel handling device of the present invention described above thus is a one piece design that easily adjusts to the width of the reel to be lifted. The device sits on a stand when not in use so that a forklift truck can drive to the stand and insert its forks into the device without the driver having to lift anything manually or get off of the forklift. The driver can easily lock the device onto the forks without tools using the locking hand screws. When the forklift operator is finished using the device, he loosens the locking hand screws and sets the device on its stand. The reel lifter arms of the device are always aligned with each other since they are attached by the telescoping assembly and the forklift driver has only to drive straight into the stand to have the lifting hooks properly aligned with each other. Furthermore, only one ball-lock pin per side is used to secure the hook portions of the reel lifter arms in the correct positions. No hand tools are required to remove or insert the ball-lock pins. The device will also pick up the full range of reel sizes from X to X1.

While the preferred embodiments of the invention have been shown and described, it will be apparent to those skilled in the art that changes and modifications may be made therein without departing from the spirit of the invention, the scope of which is defined by the appended claims.

What is claimed is:

1. A device for handling reels comprising:

a) a telescoping assembly, the telescoping assembly telescoping in a first direction;

b) a first fork sleeve and a second fork sleeve attached to the telescoping assembly so that a position of the first fork sleeve may be adjusted with respect to a position of the second fork sleeve;

c) a first reel lifter fitting and a second reel lifter fitting attached to the telescoping assembly so that a position of the first reel lifter fitting may be adjusted with respect to a position of the second reel lifter fitting; and d) a first reel lifter arm having a first hook portion and a second reel lifter arm having a second hook portion, said first reel lifter arm slidingly received within the first reel lifter fitting and said second reel lifter arm slidingly received within the second reel lifter fitting, the first and second reel lifter arms slidable within their respective reel lifter fittings in a second direction transverse to the telescoping direction, and independent of telescoping the telescoping assembly, wherein the telescoping assembly includes an inner slider bar attached to the first fork sleeve and the first reel lifter fitting and an outer slider bar attached to the second fork sleeve and the second reel lifter fitting, wherein the inner slider bar is slidingly received within the outer slider bar, and wherein the telescoping assembly is configured to accommodate reels having differing widths.

2. The device for handling reels of claim 1 further comprising openings in the first and second reel lifter fittings and a plurality of locator holes formed in the first and second reel lifter arms, a first pin sized to engage the opening of the first reel lifter fitting and the plurality of locator holes in the first reel lifter arm and a second pin sized to engage the opening of the first reel lifter fitting and the plurality of locator holes in the first reel lifter arm.

3. The device for handling reels of claim 2 wherein the first and second pins are ball-lock pins.

4. The device for handling reels of claim 3 wherein the first and second ball-lock pins include pull rings.

5. The device for handling reels of claim 1 wherein the first and second fork sleeves include threaded openings and further comprising a first locking hand screw engaging the threaded opening of the first fork sleeve and a second locking hand screw engaging the threaded opening of the second fork sleeve.

6. The device for handling reels of claim 5 wherein each locking hand screw includes a threaded shaft and a handle.

7. The device for handling reels of claim 5 further comprising first and second bosses positioned on the first and second fork sleeves having threaded bores and wherein the threaded openings are the threaded bores of first and second bosses.

8. The device for handling reels of claim 1 wherein the inner slider bar includes an elongated slot and the outer slider bar includes a slider pin that engages the inner elongated slot.

9. The device of claim 1 further comprising a stand featuring a base, a main vertical support having a first and second end and a cradle, where the first end of the main vertical support is attached to said base and said cradle is attached to the second end of the main vertical support.

10. The device for handling reels of claim 9 wherein the cradle include a V-shaped channel.

11. A system for handling a reel having an arbor hole comprising:

a. a reel handing device including:

a device for handling reels comprising:

i) a telescoping assembly, the telescoping assembly telescoping in a first direction;

ii) a first fork sleeve and a second fork sleeve attached to the telescoping assembly so that a position of the first fork sleeve may be adjusted with respect to a position of the second fork sleeve;

iii) a first reel lifter fitting and a second reel lifter fitting attached to the telescoping assembly so that a position of the first reel lifter fitting may be adjusted with respect to a position of the second reel lifter fitting;

iv) a first reel lifter arm having a first hook portion and a second reel lifter arm having a second hook portion, said first reel lifter arm slidingly received within the first reel lifter fitting and said second reel lifter arm slidingly received within the second reel lifter fitting, the first and second lifter arms slidable within their respective reel lifter fittings in a direction transverse to the telescoping direction and independent of telescoping the telescoping assembly;

b. a stand including a base, a main vertical support having a first and second end and a cradle, where the first end of the main vertical support is attached to said base and said cradle is attached to the second end of the main vertical support;

c. a special shaft adapted to be positioned through the arbor hole of the reel and having a first end and a second end; and d. a rack including a pair of generally parallel reel supports adapted to support the first and second ends of the special shaft, wherein the telescoping assembly includes an inner slider bar attached to the first fork sleeve and the first reel lifter fitting and an outer slider bar attached to the second fork sleeve and the second reel lifter fitting, wherein the inner slider bar is slidingly received within the outer slider bar, and wherein the telescoping assembly is configured to accommodate reels having differing widths.

12. The system of claim 11 wherein the first end of the special shaft includes a first square end plate and the second end of the special shaft includes a second square end plate and wherein each of the reels supports of the rack features a generally J-shaped cross section.

13. The system of claim 11 wherein the cradle include a V-shaped channel.

14. The system of claim 11 wherein the reel handing device further comprises openings in the first and second reel lifter fittings and a plurality of locator holes formed in the first and second reel lifter arms, a first pin sized to engage the opening of the first reel lifter fitting and the plurality of locator holes in the first reel lifter arm and a second pin sized to engage the opening of the first reel lifter fitting and the plurality of locator holes in the first reel lifter arm.

15. The system of claim 11 wherein the first and second fork sleeves of the reel handling device include threaded openings and further comprising a first locking hand screw engaging the threaded opening of the first fork sleeve and a second locking hand screw engaging the threaded opening of the second fork sleeve.

16. The system of claim 11 wherein the inner slider bar includes an elongated slot and the outer slider bar includes a slider pin that engages the inner elongated slot.

* * * * *